US006763892B2

(12) United States Patent
Kaszuba

(10) Patent No.: US 6,763,892 B2
(45) Date of Patent: Jul. 20, 2004

(54) SLIDING SLEEVE VALVE AND METHOD FOR ASSEMBLY

(76) Inventor: Frank Kaszuba, 10805 27th Street South East, Calgary Alberta (CA), T2Z 3V9

( * ) Notice: Subject to any disclaimer, the term of this patent is extended or adjusted under 35 U.S.C. 154(b) by 0 days.

(21) Appl. No.: 10/158,850

(22) Filed: Jun. 3, 2002

(65) Prior Publication Data

US 2003/0056951 A1 Mar. 27, 2003

Related U.S. Application Data

(60) Provisional application No. 60/324,253, filed on Sep. 24, 2001.

(51) Int. Cl.[7] ..... E21B 34/14; E21B 34/06

(52) U.S. Cl. ..... 166/373; 166/332.7; 166/334.4; 166/332.1

(58) Field of Search ..... 166/373, 386, 166/332.7, 332.4, 332.1, 324, 334.4

(56) References Cited

U.S. PATENT DOCUMENTS 4,487,261 A * 12/1984 Gazda ..... 166/264
4,493,373 A 1/1985 Jackson
4,848,457 A 7/1989 Lilley
4,880,059 A 11/1989 Brandell et al.
4,915,175 A * 4/1990 Mashaw, Jr. ..... 166/332.7
4,991,654 A * 2/1991 Brandell et al. ..... 166/332.7
5,012,871 A 5/1991 Pleasants et al.
5,183,114 A 2/1993 Mashaw et al.
5,211,241 A 5/1993 Mashaw et al.
5,263,683 A 11/1993 Wong
5,305,833 A 4/1994 Collins
5,316,084 A * 5/1994 Murray et al. ..... 166/332.4
5,479,989 A 1/1996 Shy et al.
5,488,992 A 2/1996 Pringle
5,615,741 A 4/1997 Coronado
5,697,449 A 12/1997 Hennig et al.
5,957,207 A * 9/1999 Schnatzmeyer ..... 166/332.1
5,957,208 A * 9/1999 Schnatzmeyer ..... 166/373
6,044,908 A 4/2000 Wyatt
6,112,816 A 9/2000 Orzechowski
6,182,766 B1 2/2001 Rogers et al.
6,318,729 B1 * 11/2001 Pitts et al. ..... 277/511
6,334,487 B1 * 1/2002 Adkins et al. ..... 166/55.7
6,575,246 B2 * 6/2003 Bixenman et al. ..... 166/278

* cited by examiner

*Primary Examiner*—David Bagnell
*Assistant Examiner*—Shane Bomar
(74) *Attorney, Agent, or Firm*—J. Goroon Thomson

(57) ABSTRACT

A sliding sleeve valve and method for assembly is disclosed. The valve comprises a segmented main body that is assembled from a top, middle and bottom segments. The middle segment has flow apertures. A closing sleeve is co-axially mounted in the assembled main body. The closing sleeve has flow apertures that are intended to communicate with the flow apertures of the middle section when the valve is open. The closing sleeve is sealed by seal means within the main body to prevent undesired fluid flow across the valve. The seal means comprise primary, secondary and tertiary seals acting in cooperative combinations. The seals comprise O-Ring and Vee-stack seals located within the body of the valve. The sliding sleeve valve has a fluid pressure equalization means to permit equalization of fluid pressure across the valve before it is fully opened or fully closed in order to reduce wear on the seals. The equalization means comprises a plurality of pressure equalization ports in the sliding sleeve that are intended to communicate with the main body apertures prior to the sliding sleeve apertures when opening and subsequent to the sliding sleeve apertures when closing.

12 Claims, 9 Drawing Sheets

TOP 46
56
22
15
12
58b
92b
58a
92a
80d
80c
80b
80a
OPEN POSITION 56
58
15
12
EQUALIZING POSITION 46
56
22
15
12
91b
CLOSED POSITION
92
94
91a

SLIDING SLEEVE VALVE AND METHOD FOR ASSEMBLY

CROSS REFERENCE TO RELATED APPLICATIONS

The application is related to and entitled to the benefit of Provisional Patent Application 60/324,253 "Sliding Sleeve Valve" having a United States Filing date of Sep. 24, 2001.

REFERENCE TO MICROFICHE APPENDIX

Not applicable.

BACKGROUND OF THE INVENTION

1. Field of the Invention

This invention relates to apparatus adapted for use in a deep well as might be found in oil and gas exploration and production more particularly relates to an improved sliding sleeve valve installed on to a tube string.

2. Discussion of the Prior Art

Sliding sleeve valves are well known for deep down-hole applications in gas and oil exploration and production wells. Typically a sliding sleeve valve is used to control fluid flow between a string of tubing and the annulus between the tubing and the well wall. The flow of fluid through the sliding sleeve valve may be from hydrocarbon bearing strata to the surface in a production scenario. Alternatively, the flow of fluid may be from the surface into a particular hydrocarbon-bearing stratum for selective treatment for hydrocarbon recovery enhancement or well stimulation. In the latter application, a corrosive fluid such as an acid may be injected into hydrocarbon bearing strata to enhance hydrocarbon recovery. Alternatively, operating fluid may be applied to a hydrocarbon bearing strata under very high pressures to stimulate the well and enhance recovery.

The operation of such sliding sleeve valves are controlled by known wire line or hydraulic pressure actuated shifter tools. These tools selectively operate the sliding sleeve valve and lock it into a desired operating position at a desired depth in the well bore.

Examples of sliding sleeve valves can be found in U.S. Pat. No. 5,479,989 issued to Shy et al on Jan. 2, 1996 entitled "Sleeve Valve Flow Control Device with Locator Shifter", U.S. Pat. No. 5,211,241 issued to Mashaw et al on May 18, 1993 entitled "Variable Flow Sliding Sleeve Valve and Positioning Shifting Tool Therefore", U.S. Pat. No. 5,183,114 issued to Mashaw et al on Feb. 2, 1993 entitled "Sleeve Valve Device and Shifting Tool Therefore" and U.S. Pat. No. 6,044,908 issued to Wyatt on Apr. 4, 2000 entitled "Sliding Sleeve Valve and Seal Ring For Use Therein".

Critical to the successful operation of a sliding sleeve valve in deep well operations is the integrity of the valve seals. Sliding sleeve valves are known to operate under extreme fluid pressures, temperatures and in corrosive environments. Known sliding sleeves have a variety of seal configurations but many still suffer from undesired leakage especially after they have undergone numerous opening and closing cycles. Known sliding sleeve valves have a single leak paths at the top and/or bottom segments. Therefore, there is an ongoing requirement for a sliding sleeve valve that eliminates this leak path and operates reliably and leak-free under a variety of operating conditions and after numerous opening and closing cycles.

SUMMARY OF THE INVENTION

The present invention provides for a sliding sleeve valve that can be easily installed at a well site without the need for special tools or training. The sliding sleeve valve of the present invention is capable of reliable and selective operation at extreme depths while maintaining leakage integrity after numerous opening and closing cycles.

The present invention comprises a sliding sleeve valve assembly having a tubular main body threadably attached to a tube string. A tubular closing sleeve is co-axially and slidably mounted within the tubular main body for axial movement therein. The tubular main body comprises a top, middle and bottom segments. These segments are threadably engaged with each other to make for easy installation without the need for special tools.

The middle segment of the main body and the closing sleeve both have fluid flow apertures. When the sliding sleeve valve is in the open position, the flow apertures in the closing sleeve are in communication with the fluid flow apertures in the middle segment of the main body permitting fluid flow across the valve. The fluid flow apertures in the closing sleeve and middle segment are sufficiently sized so that when they are in communication with each other, the total flow in the tube string can be accommodated through the communicating apertures. The closing sleeve is attached to and controlled by a wire or hydraulic tool string. The sliding sleeve valve has a fully closed position, an equalizing position and a fully open position.

In operation, the tube string may be under greater pressure than the formation resulting in fluid flows across the open sleeve valve from the tube string to the formation. Alternatively, the formation may be under greater pressure than the tube string resulting in fluid flows across the open sleeve valve from the formation into the tube string. When the sleeve valve is closed, the resulting pressure differential across the valve may result in leakages into or out of the sleeve valve along a pathway that is generally defined along those areas where the top, middle and bottom segments come together. My invention provides for triple seal redundancy to seal the leakage pathway in both directions across the closed sleeve valve.

Another aspect of the invention is the controlled equalization feature that equalizes pressure across the valve during opening and closing operations. This reduces pressure and stress on the seals which assists them in maintaining their leakage integrity over multiple opening and closing operations. In addition the controlled pressure equalization reduces operation problems with the shifting tool string. The equalization feature comprises a plurality of equalization ports set radially in the closing sleeve. In operation and when opening the sliding sleeve valve, the equalization ports will be in communication with the fluid flow apertures of the middle segment of the main body for a predetermined amount of time and before the fluid flow apertures of the closing sleeve come into communication with the fluid flow apertures of the middle segment. This permits fluid pressures to equalize across the valve body so that seal pressures are reduced and resistance offered to the shifting tool caused by the pressure differential across the valve body is also reduced. When the sleeve valve is being closed, the equalization ports will remain in communication with the apertures of the middle segment after the apertures of the closing sleeve are non-communicative thereby permitting a gradual change in pressure over the body of the sleeve valve. The equalization ports also relieve trapped pressure between the seals when the valve is fully opened or closed. This reduces the instances of "pressure lock" during repeated opening and closing operations of the valve.

OBJECTS OF THE INVENTION

Accordingly, several objects and advantages of my invention are set out below.

A principal object of my invention is to provide a sliding sleeve valve that has an improved triple redundancy configuration to resist leakage between the tubing and the annulus after numerous opening and closing cycles.

It is an object of my invention to provide an improved sliding sleeve valve that can be easily installed at the well site without the need for special tools or operator skills.

It is another object of my invention to provide a sliding sleeve valve that is capable of selective and reliable operating at extreme depths within a well hole under a variety of operating conditions.

Yet another object of my invention is to provide a sliding sleeve valve that can be easily adapted to cold weather operations, hot well conditions and varying well conditions.

Still another object of my invention is to provide an improved sliding sleeve valve with a fluid pressure equalization feature.

Another object of my invention is to provide a sliding sleeve valve that permits the release of trapped pressure between the seals and prevents the occurrence of pressure lock during valve operation.

The above and other objects of my invention will become clear from the drawings, detailed description and claims appended hereto.

DETAILED DESCRIPTION OF THE INVENTION

Figure 1:
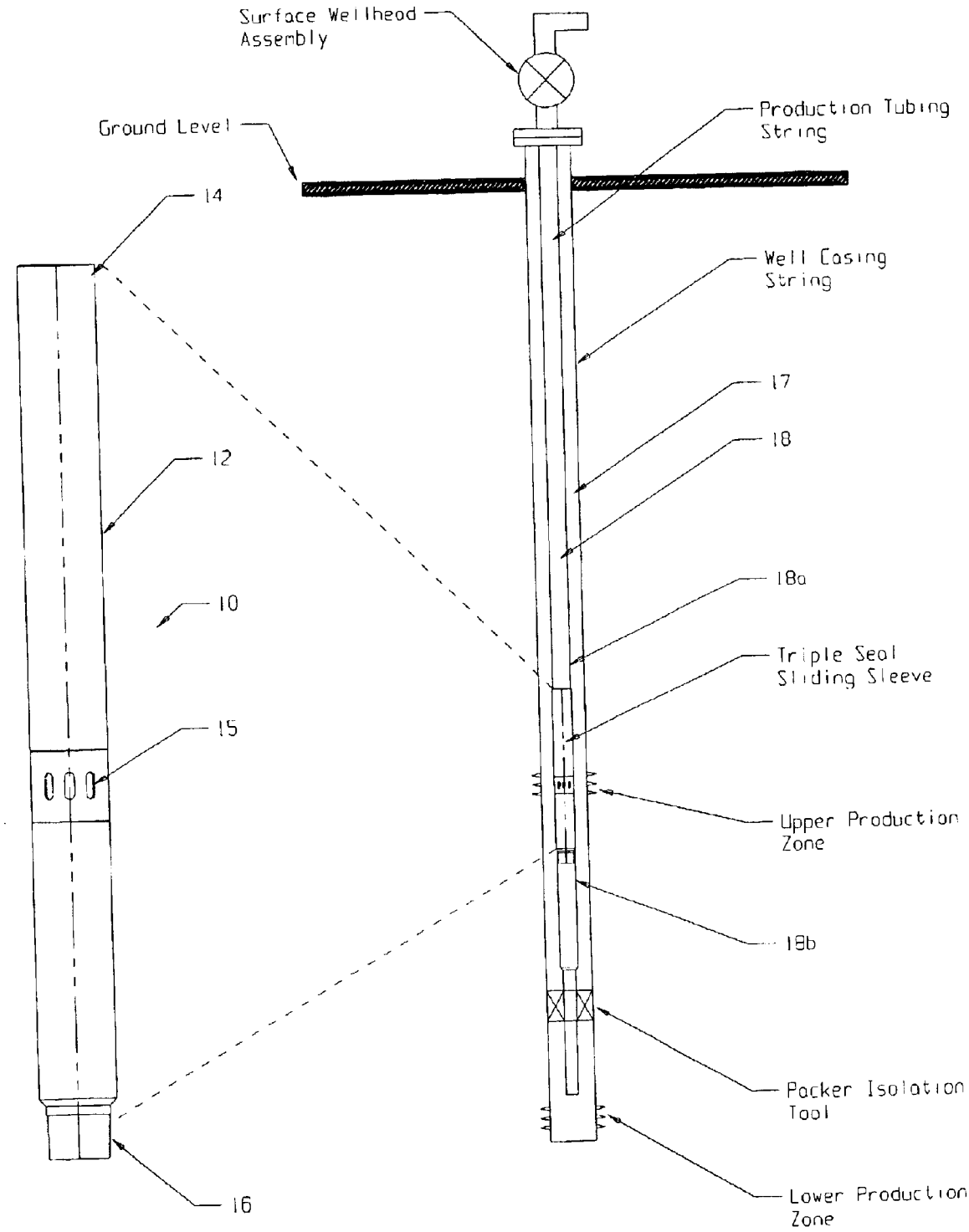
FIG. 1 is a side view of one embodiment of my invention in a drill hole.

FIG. 1 shows a sectional side view of the outside of the sliding sleeve valve (10) of my invention installed in a drill hole. My valve comprises a tubular main body (12) that is threaded at both ends (14) and (16). Threaded ends (14) and (16) are adapted to thread into a tube string (18*a*) and (18*b*) respectively at any position along the tube string. The tubular body has an apertured portion (15) to permit fluid communication between the drill bore annulus (17) and the centre of the tube string (18).

Figure 2:
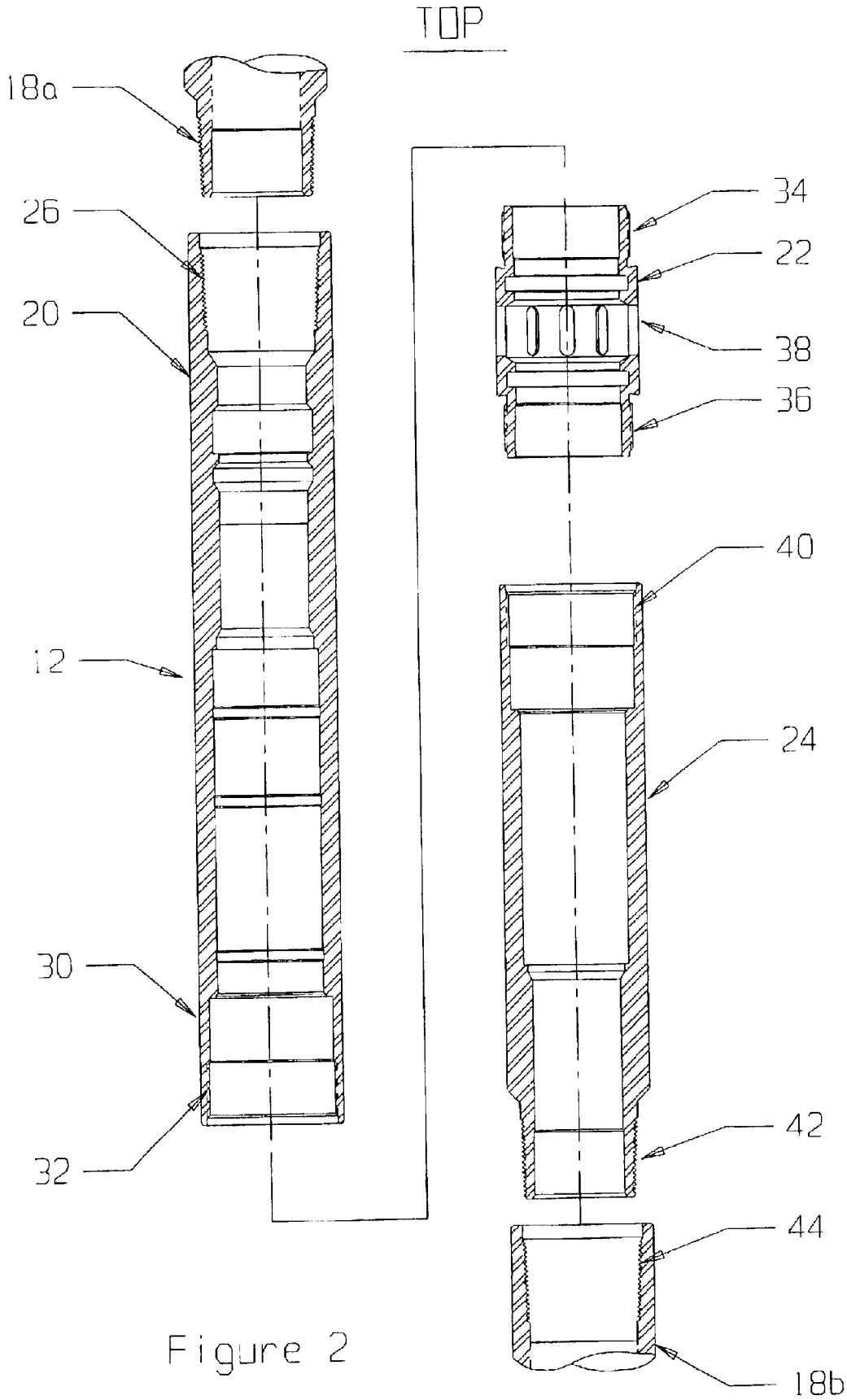
FIG. 2 is a disassembled sectional side view of the main valve body of one embodiment of my invention.

Referring to FIG. 2, there is shown a disassembled sectional view of the tubular main body (12) of my invention. Tubular body (12) is fabricated as three separate segments. There is a top segment (20), a middle segment (22) and a bottom segment (24). Top segment (20) has an upper internally threaded section (26) adapted to receive a threaded end of the tube string (18*a*). The opposite end (30) of top segment (20) has an internally threaded section (32) adapted to receive threads (34) from the middle segment (22). Middle segment (22) comprises identical upper (34) and lower (36) externally threaded portions and a middle apertured portion (38). Upper (34) and lower (36) threads are adapted to receive threads from the bottom (30) of top segment (20) and the top portion (40) of bottom segment (24). Bottom segment (24) comprises a top internally threaded portion (40) adapted to receive middle segment external threads (36) and a bottom-threaded portion (42) adapted to receive threads (44) of the tube string (18*b*). The main body (12) can be easily transported to a well site and easily threaded together onto the tubing string.

Figure 3A:
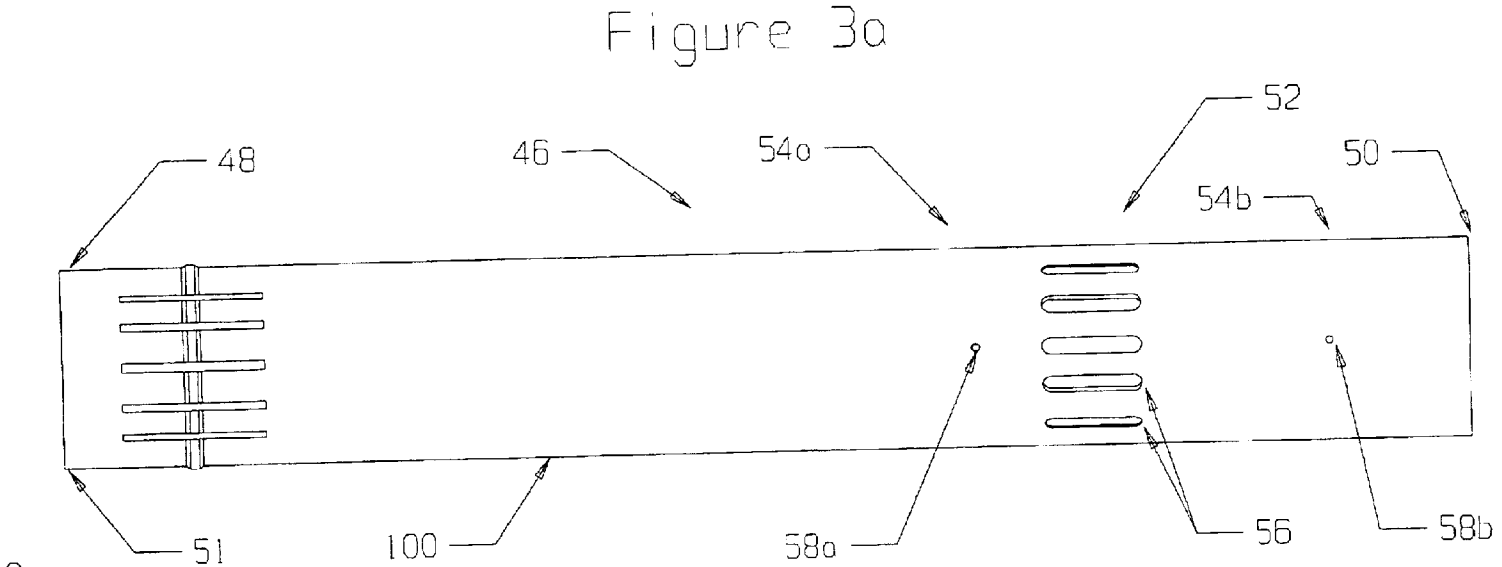
FIG. 3*a* is a side view of the closing sleeve of one embodiment of my invention.
Figure 3B:
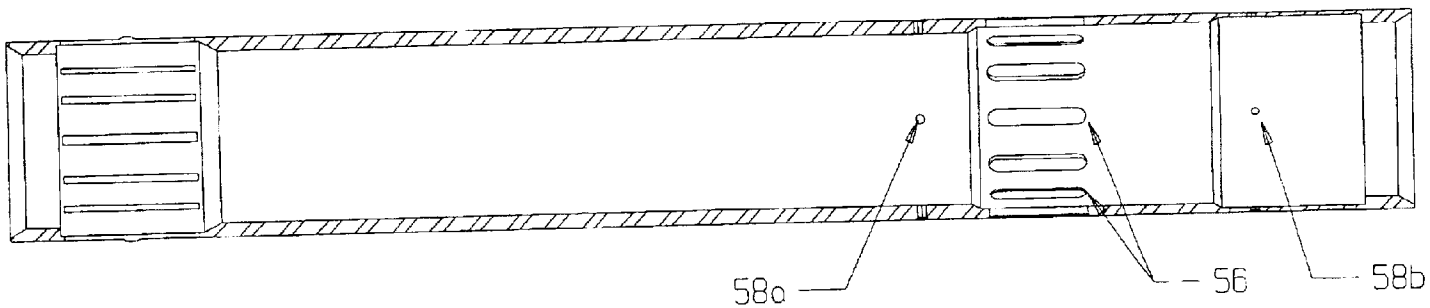
FIG. 3*b* is a sectional side view of the closing sleeve of the same embodiment of my invention as shown in FIG. 3*a*.

Referring to FIG. 3 and specifically to FIG. 3*a*, there is shown a closing sleeve (46) of one embodiment of my invention. The closing sleeve is non-segmented hollow tube having an upper portion (48) a lower portion (50), an apertured portion (52), an upper ported portion (54*a*) having equalization ports (58*a*) and a lower ported portion (54*b*) having equalization ports (58*b*). Apertures (56) are adapted to communicate with apertures (15) in the main body (12). When in communication, apertures (56) and (15) permit a flow of fluids between the annulus (17) and the production tubing string (18). Equalization ports (58*a*) are adapted to permit fluid flow across the valve body so that pressure outside the valve body and inside the valve body are equalized before the main flow apertures (15) and (56) communicate or cease communication. This serves to reduce the pressure differential across the assembly, facilitate movement of the tool string and reduce pressure on the seals. FIG. 3*b* shows the closing sleeve in cross-section.

Figure 4:
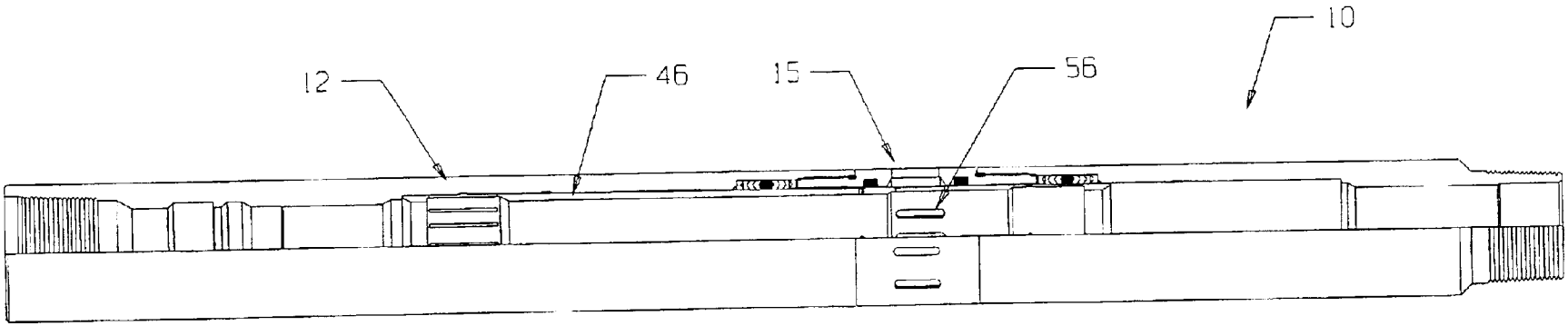
FIG. 4 is a sectional side view of the closing sleeve positioned within the main valve body of one embodiment of my invention.

Referring now to FIG. 4, there is shown one embodiment of my invention (10) where the closing sleeve (46) is shown positioned within the main body (12) of the valve. The valve is shown in its open configuration wherein apertures (15) of the valve body (12) are in communication with the apertures (56) of the closing sleeve (46).

It is understood by those skilled in the art that the closing sleeve is controllably connected to the surface of the well by wire line or hydraulically operated tool string.

Figure 5:
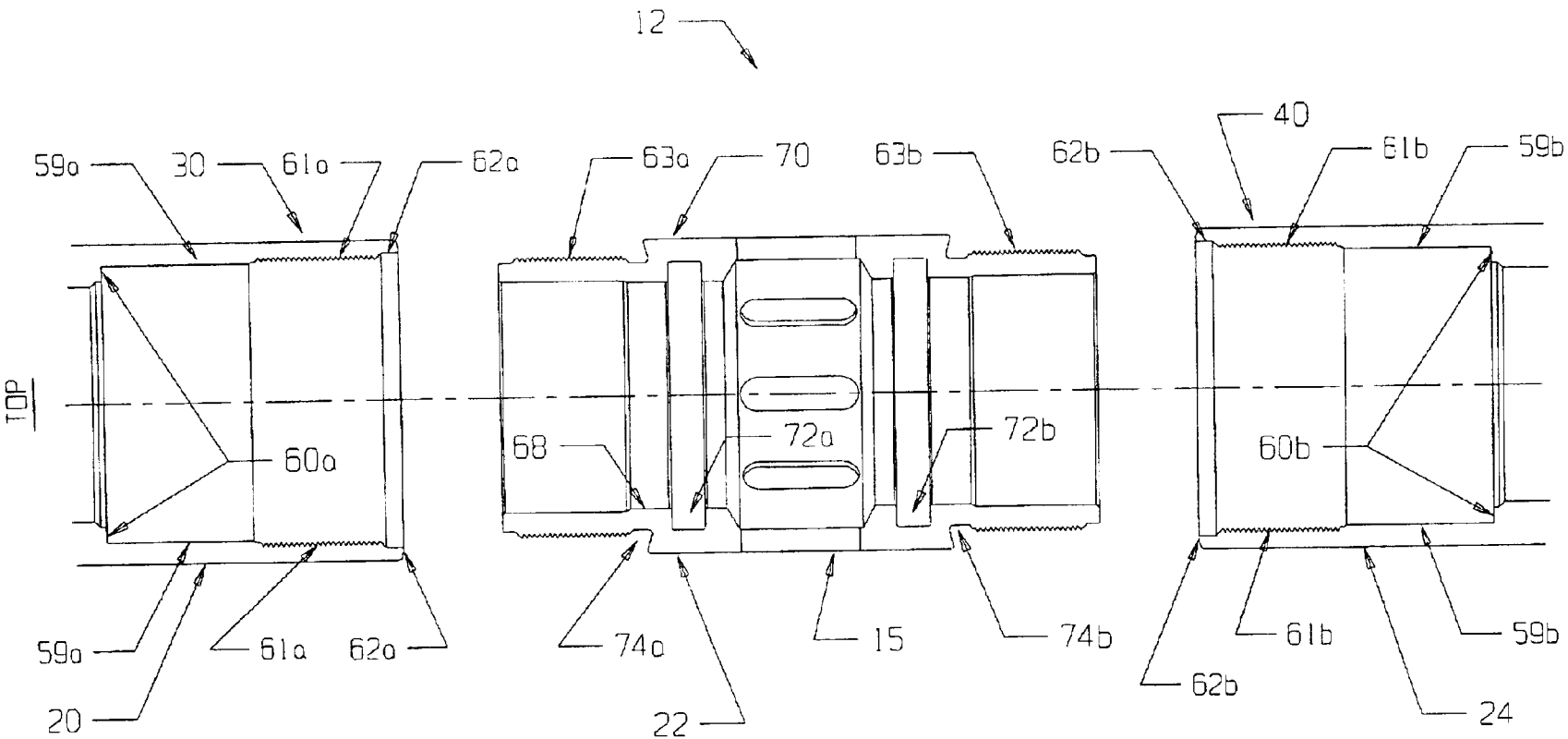
FIG. 5 is a disassembled sectional side view of the main valve body of my invention.

Referring to FIG. 5, there is shown a detailed disassembled sectional side view of the main valve body (12) illustrating various innovative features of my invention. Top segment (20), middle segment (22) and bottom segment (24) are shown in a disassembled configuration. The bottom end (30) of top segment (20) has machined into it recess (59*a*), shoulder (60*a*), threads (61*a*) and bevel (62*a*). Similarly, the top end (40) of bottom segment (24) has machined into it recess (59*b*), shoulder (60*b*), threads (61*b*) and bevel (62*b*). Middle segment (22) of the main body (12) has an inside surface (68) and an outside surface (70). Machined into the inside surface (68) of middle segment (22) are channels (72*a*) and (72*b*). The channels (72) are identical and equally spaced above and below the fluid flow apertured section (15). Machined into the outside surface (70) of middle segment (22) are channels (74*a*) and (74*b*) equally spaced above and below the fluid flow apertured section (15) with channel (74*a*) immediately below thread (63*a*) and channel (74*b*) immediately above thread (63*b*).

Figure 6:
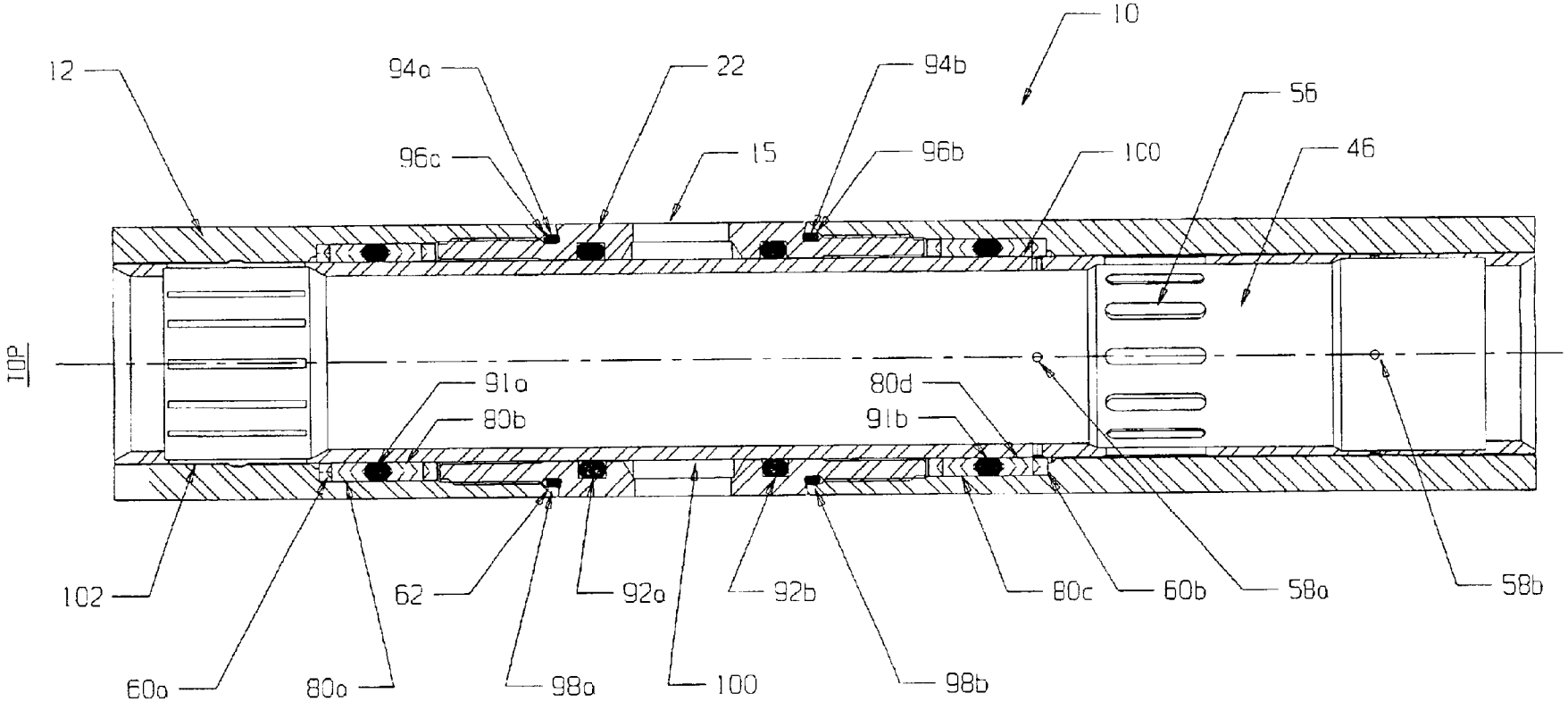
FIG. 6 is a sectional side view of the sliding sleeve valve of one embodiment of my invention showing the seal arrangement.

Referring now to FIG. 6, there is shown in cross sectional view an assembled sliding sleeve valve (10) of one embodiment of my invention. Closing sleeve (46) is positioned within the valve body (12). The valve is shown in a closed position so that fluid flow apertures (56) are not in communication with fluid flow apertures (15) of the main body. Similarly, equalization ports (58*a*) are not in communication with fluid flow apertures (15) of the main body. Further illustrated in FIG. 6 is the novel triple seal configuration of my invention.

As previously discussed, one operation scenario using the sliding sleeve valve involves the internal pressure in the pipe string (18) being much greater than the fluid pressure in the annulus of the bore hole (17). This causes a potential leakage pathway between the tube string (18) through closed apertures (56) and collet slots (102) along the surface (100) of the closing sleeve (46) and past the made threads (63*b* and 61*b*) joining segments (22) and (24) and made threads (61*a* and 63*a*) joining segments (20) and (22). In this operation scenario, triple redundancy sealing is provided as follows:

a. a first (primary) seal in the leakage pathway along surface (100) is provided by O-Ring (91*a*) and (91*b*) between the surface (100) of the closing sleeve (46) and the inside surface of recesses (59*a*) and (59*b*) of segments (20) and (24);

b. a second (secondary) seal in the leakage pathway is provided by Vee-stacks (80*b* and 80*c*) set within recesses (59*a* and 59*b*) respectively abutting against the top and bottom ends of segment (22). Pressure on the Vee seal stacks will cause the seals to butt firmly in a sealing relationship against the top and bottom ends of segment (22);

c. a third (tertiary) seal in the leakage pathway is provided by O-Ring seals (92*a*) and (92*b*) within channels (72*a*) and (72*b*) respectively to seal the leakage pathway along the outside face (100) of the closing sleeve (46) and the apertures (15). The third seal also comprises O-Ring seals (94*a*) and (94*b*) within cavities (96*a*) and (96*b*) respectively to seal the threaded joints between segments (20) and (22) and segments (22) and (24);

In a second operating scenario, the annulus (17) is at a greater fluid pressure than the tube string (18). The potential leakage pathway exists from the annulus into the tube string through apertures (15) and between the threaded joints of segments (20) and (22) and segments (22) and (24). In this scenario, triple redundancy sealing is provided by:

a. a first (primary) seal in the leakage pathway is provided by O-rings (92*a*) and (92*b*) in channels (72*a*) and (72*b*) respectively, positioned between aperture (15) and the outside face (100) of closing sleeve (46) and O-Rings (94*a*) and (94*b*) within cavities (96*a*) and (96*b*) respectively sealing the pathway between the threaded joints of segments (20) and (22) and segments (22) and (24);

b. a second (secondary) seal in the leakage pathway along surface (100) is provided by O-Rings (91*a*) and (91*b*) between surface (100) of the closing sleeve (46) and the inside surface of recesses (59*a*) and (59*b*) of segments (20) and (24);

c. a third (tertiary) seal in the leakage pathway is provided by Vee-stack seals (80*a* and 80*d*) set within recesses (59*a*) and (59*b*) and abutting against shoulders (60*a*) and (60*b*) respectively sealing between surface (100) of closing sleeve (46) and the inside surface of segments (20) and (24).

Figure 7:
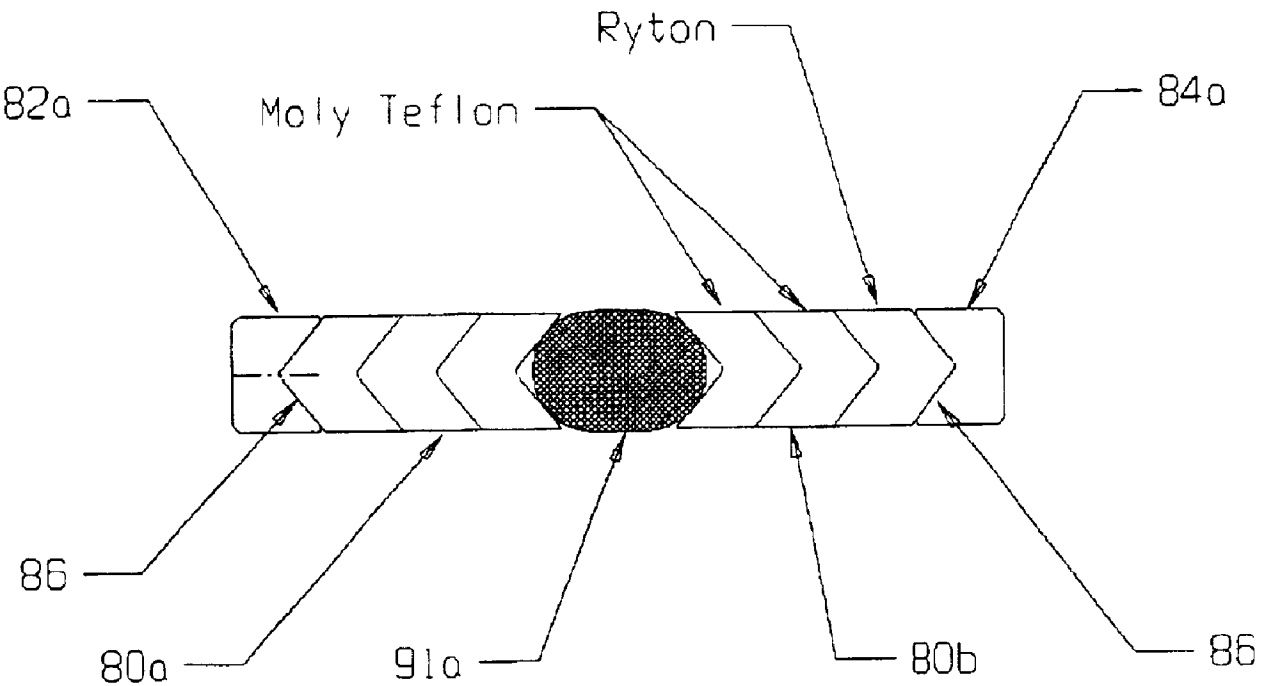
FIG. 7 is a sectional side view of the Vee-stack seals of one embodiment of my invention.

Referring to FIG. 7, there is shown a detailed view of Vee-stack seals (80*a* and 80*b*) in combination with O-Ring seal (91*a*). The Vee-stack seal comprises a top (82*a*) and bottom (84*a*) female adapter rings. Adapter rings are may be fabricated from 4140 L-80 stainless steel and are preferably fabricated from 9Cr1Mo or 13 Cr stainless steel. The inside surface of the adapter rings are grooved (86) to accept Vee-seal packs (80*a*) and (80*b*). Preferably the Vee-seal packs are made from a suitable elastomeric compound. One example is moly/carbon Teflon® seal packs. The seal packs may also be made from a combination of VITON™ and RYTON™ substances. O-ring (91*a*) is sandwiched between the seal packs (80*a*) and (80*b*). The O-ring is preferably a Viton®90 Duro O-ring but it may also be any of the elastomeric compounds suitable for the down hole service environment such as Nitrile™, Aflas™, Kalrez™, Neoprene™, Flourosilicon or EPDM.

Referring back to FIG. 5 and FIG. 6, seals (92*a*) and (92*b*) are placed within channels (72*a*) and (72*b*) respectively. Seals (92*a*) and (92*b*) are preferably Viton®90 Duro O-Rings. Since the O-rings are made from an elastomeric material, they can be easily placed within the channels during assembly. Once placed in the channel, the resiliency of the O-ring keeps it in place during assembly operations. One advantage of my invention is the fact that these O-rings may be changed to suit cold weather operations, hot well operations and varying well conditions. A typical O-ring suitable for cold weather operations may be 70 DURO Viton™.

Seals (94*a*) and (94*b*) are placed into channels (74*a*) and (74*b*) respectively located on the outside surface of middle segment (22). Once the main body (12) is assembled from its three segments, bevels (62*a*) and (62*b*) and channels (74*a*) and (74*b*) are positioned adjacent to each other to form cavities (96*a*) and (96*b*) in which seals (94*a*) and (94*b*) respectively will sit. As the top (20) and bottom (24) segments are threaded onto middle segment (22) the seals (94*a*) and (94*b*) are compressively maintained within the cavity (96*a*) and (96*b*) thus providing an effective seal against undesired fluid flow at joints (98*a*) and (98*b*).

Still referring to FIG. 6, the top (80*a* and 80*b*) and bottom (80*c* and 80*d*) Vee stack seals, seals (91*a*) and (91*b*) and seals (92*a*) and (92*b*) are in sliding contact with the outside surface (100) of closing sleeve (46). It is understood that the tolerances between the outside surface (100) of closing sleeve (46) and the inside surface of the main valve body must be within concentricity tolerances to allow the easy sliding movement of the closing sleeve within the main body of the valve while being sufficiently small to prevent seal extrusion and so that the seals will be effective in preventing undesired fluid flows along the sliding pathway. However, even small tolerances with high operating pressures may encourage an undesirable fluid flow between the closing sleeve and the main valve body between the tube string and the annulus. Therefore the seals act redundantly to prevent such a fluid flow.

Figures 8A, 8B, 8C:
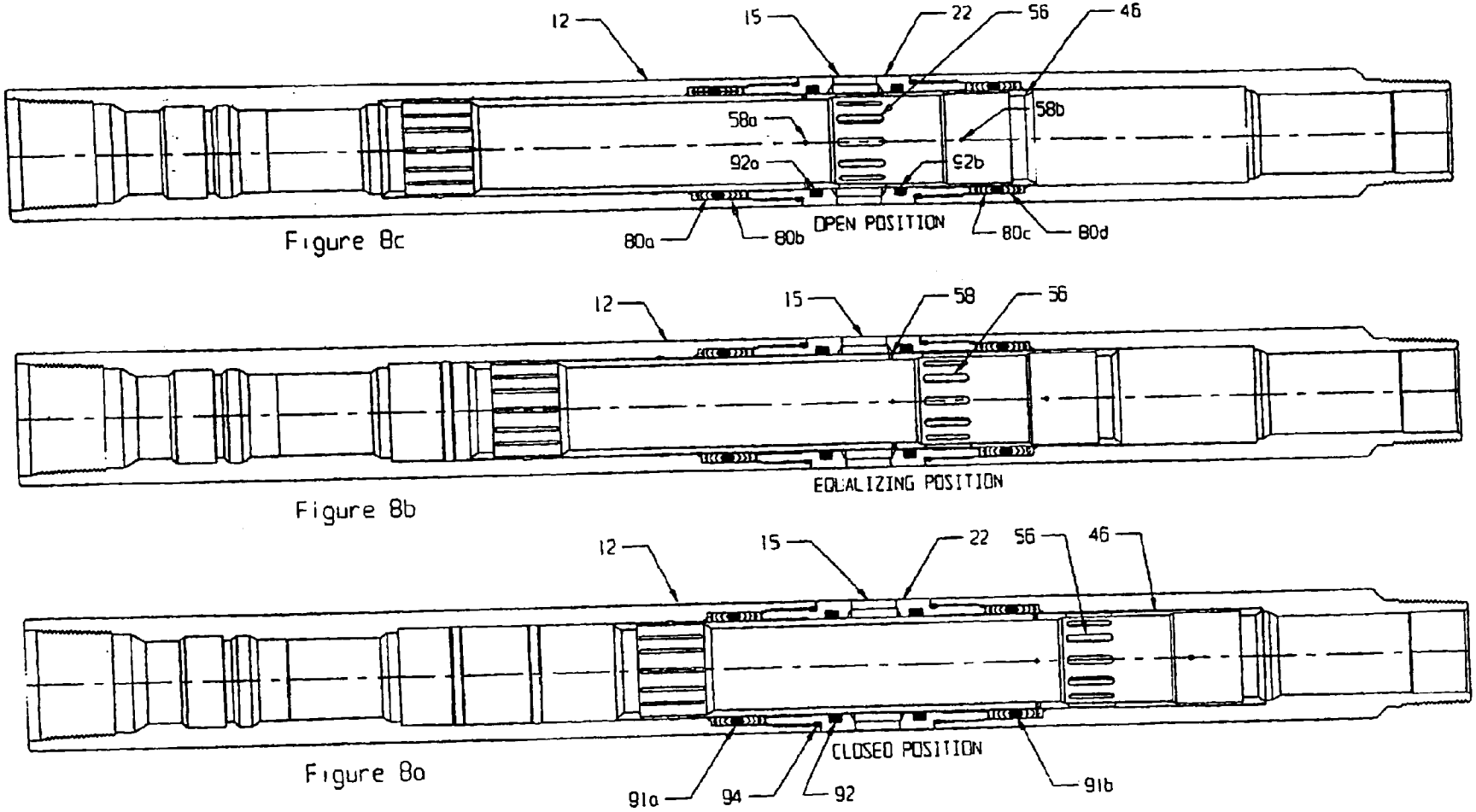
FIG. 8*a* shows my invention in a closed position.
FIG. 8*b* shows my invention in the equalizing position.
FIG. 8*c* shows my invention in an open position.

Referring to FIGS. 8*a*–8*c* the valve has a first closed position, a second open position and a third equalizing position. The third equalizing position occurs between the first open position and the second closed position. Referring to FIG. 8*a*, the valve is illustrated in a closed position. The fluid flow apertures (56) of the sliding sleeve (46) are not in communication with the fluid flow apertures (15) of middle segment (22) of the main body (12). Seals act together to prevent undesired fluid flows across the valve body.

In FIG. 8*b*, the closing sleeve is shown moved by the tool string from its closed position to its equalizing position. Fluid flow apertures (56) remain non-communicative with apertures (15). Equalization ports (58*a*) are now in communication with flow apertures (15) allowing fluid pressure to equalize across the closing sleeve before the valve is moved to an open position. As illustrated in FIG. 8B, the equalization ports (58*a* and 58*b*) are substantially smaller than the flow apertures (56) and (15) in order to restrict flow.

In FIG. 8*c* the closing sleeve is shown in its full open position. Apertures (56) are in full communication with apertures (15) and fluid flow is permitted between the tube string and the annulus. Equalization ports (58*b*) acts to relieve any trapped pressure in the bottom seal system. Similarly, equalization ports (58*a*) act to relieve any trapped pressure in the top seal system. The action of equalizing pressure and relieving trapped pressure acts to reduce the instances of pressure lock during valve opening and closing operations.

Figure 9:
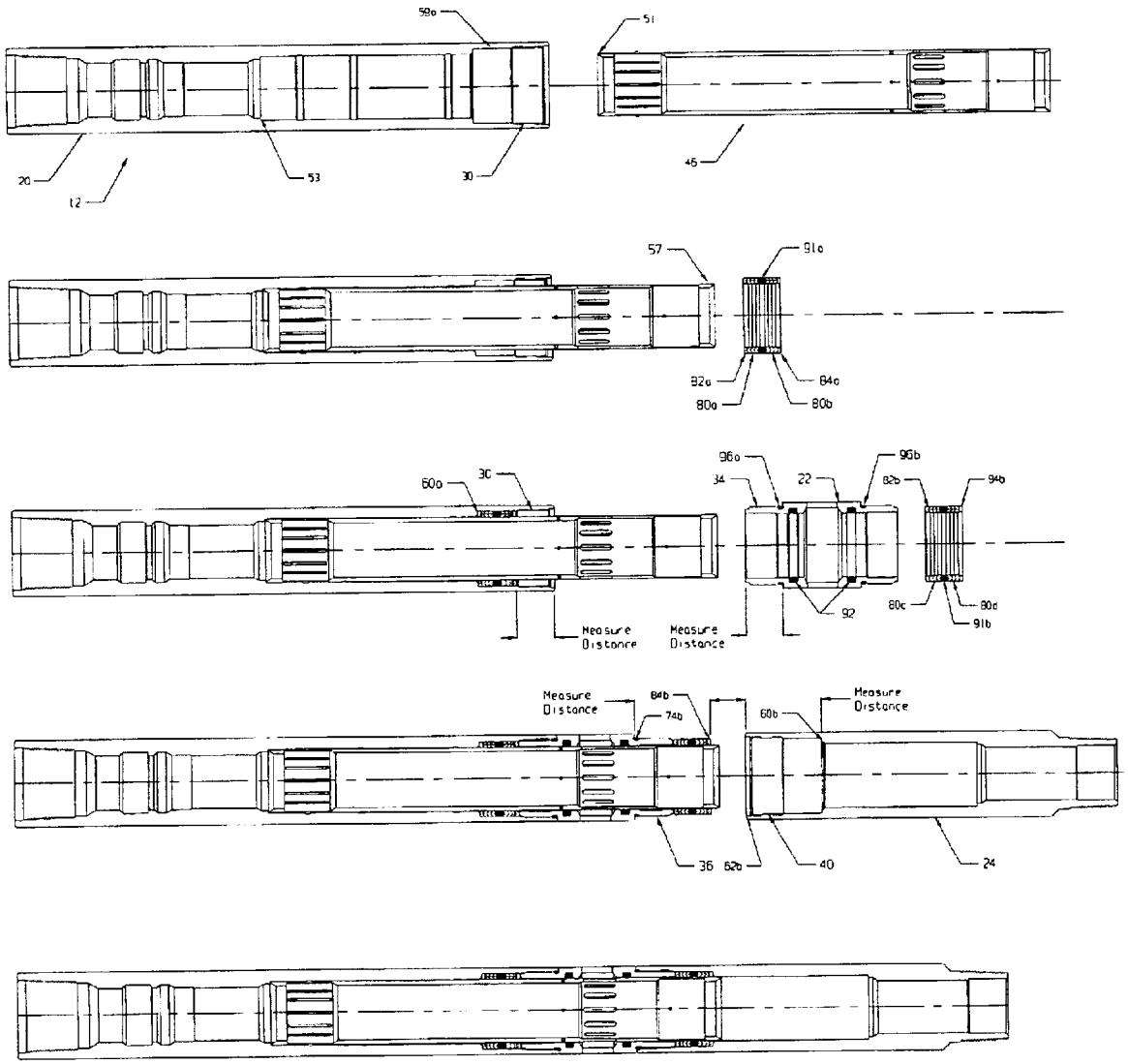
FIG. 9 shows the assembly of my invention.

Referring to FIG. 9, the assembly method comprises the following steps:

1. Take top segment (20) of main body (12) and lubricate all internal surfaces of the top segment with a suitable lubricant so that the closing sleeve (46) will slide easily within the main valve body. The lubricant is preferably a high pressure, high temperature, H2S and water resistant lubricant. The threaded portion (30) should also receive lubrication.
2. Take the closing sleeve (46) and lubricate all external surfaces of the closing sleeve with the same lubricant so that it slides easily within the main body.
3. Fully insert the closing sleeve (46) into the top segment (20) of the main valve body (12). The sliding sleeve is assembled in this manner to avoid the formation of a pressure lock between the subsequently installed seals during thread make-up of the component. Once the closing sleeve is fully inserted, the end (51) of the closing sleeve will abut against shoulders (53) machined into the top segment of the valve body. The bottom portion (57) of the sliding sleeve will extend outside of the top segment (20).
4. Assemble the seals (80*a* and 80*b*) and (91*a*) in combination comprising the following steps:
   i. Obtain a top (82*a*) and bottom (84*a*) adapter ring and lubricate them on all sides;
   ii. Obtain and lubricate a first Vee-stack (80*a*) and place it into the top adapter ring (82*a*);
   iii. Obtain an O-Ring (91*a*), lubricate it and place it onto the first V-stack (80*a*);
   iv. Obtain and lubricate a second Vee-stack (80*b*) place it over the O-ring (91*a*) so that the O-ring is sandwiched between the two adjacent Vee-stacks (80*a* and 80*b*); and,
   v. Obtain a bottom adapter ring (84*a*), lubricate it and place it over the second Vee-stack (80*b*).
5. Push assembled Vee stack/O-Ring combination seal onto the extending portion (57) of the closing sleeve and into the top segment (20) of the valve body so that the top of adapter ring (82*a*) abuts shoulder (60*a*) and the Vee-stack/O-ring combination sits in recess (59*a*).
6. Measure the dimension between the bottom of the installed seal pack and the bottom of the threaded portion (30) of the bottom segment. This distance should not be less than the length of the threaded portion (34) of the middle segment (22). Adjust as necessary so that the seal pack will not be compressed as the middle segment is threaded on to the top segment. This avoids lateral displacement of the seal that could impede the motion of the closing sleeve through cycles of opening and closing and prematurely weaken the seal.
7. Obtain O-rings (92) seal and lubricate them.
8. Install O-ring (92) into channels (72*a*) and (72*b*) in the middle segment (22).
9. Obtain and lubricate O-Ring seals (96*a*) and (96*b*).
10. Install seals (96) onto middle segment (22) so that the rings sit in grooves (74*a*) and (74*b*).
11. Lubricate top and bottom threads and internal sliding surfaces of the middle segment.
12. Install middle segment (22) onto the extending portion (57) of the closing sleeve and makeup threads (61*a*) and (63*a*) together so that they are and tight.
13. Obtain bottom segment (24) of main body (12) and lubricate all internal surfaces. Ensure that the threads (61*b*) are lubricated.
14. Repeat step 4 to assemble the Vee-stack/O-Ring combination seal (80*c*), (91*b*) and (80*d*).
15. Insert the Vee-seal stack/O-Ring combination onto the remaining extended position of the closing sleeve.
16. Measure the distance between channel (74*b*) and the bottom of adapter ring (84*b*) to ensure that it is not greater than the distance between bevel (62*b*) and shoulder (60*b*). Adjust as necessary.
17. Makeup threads (61*b*) and (63*b*) together so that they are hand tight.
18. Tighten threaded connections to a torque equal to the torque used to fasten the elements of the tubing sting together.

Additionally, my invention provides a method for testing the integrity of the sliding sleeve valve before it is placed into the well hole comprising the following steps:

1. Move the closing sleeve into the closed position.
2. Install the pressure test mandrel to the sliding sleeve valve.
3. Fill the pressure test mandrel with water and apply at least 5,000 psi for a minimum of 15 minutes. No leaks are permissible.
4. Bleed the pressure from the testing device.
5. Remove the testing device from the sliding sleeve valve.
6. Blow excess water from the inside of the sleeve using high pressure air.

Prior to installing the tested valve into the tube string a suitable thread compound is placed on the threads (26) and (42).

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A sliding sleeve valve (10) positionable in a drill hole as part of a tube string (18), said drill hole having an annulus (17) between the tube string and the drilled formation, said sliding sleeve valve having a first open position, a second closed position and a third equalizing position between said first open position and said second closed position, the sliding sleeve valve comprising:

a. a first segmented tubular body (12) comprising a top segment, a middle segment and a bottom segment co-axially and threadedly engaged, wherein said middle segment includes a first set of wall apertures (15) for desired fluid flow between the tube string and the annulus;

b. a closing sleeve (46) comprising a second non-segmented tubular body co-axially mounted within said first body in a sealed and sliding relationship with the first body, said closing sleeve having a second set of wall apertures (56) adapted for communication with said first set of apertures (15) for desired full fluid flow between the tube (18) string and the annulus (17) in said first open position;

c. sealing means for sealing undesired leakage flow pathways in a first and a second direction between said first body (12), the closing sleeve (46) and the annulus (17) said sealing means comprising a primary seal, a secondary seal and a tertiary seal located on said undesired fluid flow pathways; and, d. a plurality of equalization ports (58*a* and 58*b*) in said closing sleeve disposed in a radial pattern around the closing sleeve and above and below said second set of wall apertures (56), wherein said plurality of equalization ports operate in said third equalizing position and communicate with the first said of wall apertures to equalize pressure across the valve between the first open position and said second closed position, and wherein, the plurality of equalizing ports are substantially smaller than the second set of apertures.

2. The apparatus as claimed in 1 wherein the valve is fully open for desired fluid flow when the first (15) and second (56) set of fluid flow apertures are in communication with each other; the valve is fully closed when the first (15) and second (56) sets of fluid flow apertures are non-communicative; and, the valve is in an equalization position when the equalization ports (58*a*) are in communication with the first set of apertures (15).

3. The apparatus as claimed in claim 2 wherein:

a. said top (20) segment comprises i. a internally threaded top end section (26) for attachment to the adjacent section of a tube string (18*a*);

ii. a internally threaded bottom end section (32) for attachment to said middle segment (22);

iii. a circumferential recessed section (59*a*) having a top shoulder (60*a*) and adapted to receive seal means; and, iv. a circumferential bevel (62*a*) machined into the inside tip of the bottom of the top segment;

b. said middle segment having an external (70) and internal (68) surface and comprising:

i. an externally threaded top end section (63*a*) for attachment to the threaded bottom end section (61*a*) of the top segment (20);

ii. a radially apertured middle section (15) for full fluid flow located below the top end section (63*a*);

iii. an externally threaded bottom end section (63*b*) located below the middle section (15);

iv. a first (74*a*) and second (74*b*) groove machined circumferentially into the external surface (70) of the middle segment (22) immediately below said externally threaded top section (63*a*) and immediately above said externally threaded bottom section (63*b*) said first and second grooves respectively spaced equidistantly above and below the middle apertured section (15);

v. a third (72*a*) and fourth (72*b*) groove machined circumferentially into internal surface (68) of the middle segment and positioned respectively below and above said first (74*a*) and second (74*b*) grooves; wherein the bottom threaded section attaches to;

c. said bottom segment (24) comprising;

i. an internally treaded top end section (61*b*) for attachment to the externally threaded bottom end portion (63*b*) of the middle apertured segment (15);

ii. an externally threaded bottom end section (42) for attachment to the adjacent tube string (18*b*);

iii. a circumferential recessed section (59*b*) having a bottom shoulder (60*b*) and adapted to receive seal means, said recessed section located below said threaded portion (61*b*); and, iv. a circumferential bevel (62*b*) machined into the inside tip of the top of the bottom segment.

4. The apparatus as claimed in claim 3 wherein the joining of the segments results in said circumferential bevels associating with said first and second grooves thereby forming a first and second cavity above and below the middle apertured segment said cavities adapted to enclose seal means.

5. The apparatus as claimed in claim 4 wherein the fluid contained within the tube string is at a higher pressure than the fluid contained in the annulus and wherein said first leakage flow direction is from the tube string to the annulus and wherein:

a. primary seal means comprises a first (91*a*) and second (91*b*) O-Ring seal positioned in a fixed position within said inside circumferential recessed sections (59*a* and 59*b*) of the top (20) and bottom (24) segments so that said O-Rings are in sliding frictional and fluid sealing engagement with the outside surface (100) of the closing sleeve (46);

b. secondary seal means comprises a first (80*b*) and second (80*c*) Vee-stack seals mounted within the recessed sections (59*a* and 59*b*) of the top (20) and bottom (24) segments so that the Vee-stack seals abut each of the top and bottom tips of the middle segment (22); and, c. tertiary seal means comprises a third (92*a*) and fourth (92*b*) O-Ring seals located within each of the internal grooves (72*a* and 72*b*) of the middle segment (22) wherein the inside surface of said third and fourth O-Ring seals in sliding frictional and fluid sealing engagement with the surface (100) of the closing sleeve; and, wherein said third and fourth O-Ring seals act cooperatively with a fifth (98*a*) and sixth (98*b*) O-Ring seals located in each of the grooves (74*a* and 74*b*) of the middle segment.

6. The apparatus as claimed in claim 5 wherein the fluid contained within the tube string is at a lower pressure than the fluid contained in the annulus and wherein said second leakage flow direction is from the annulus to the tube string and wherein:

a. primary seal means comprises first (92*a*) and second (92*b*) O-Ring seals located within each of the internal grooves of the middle segment the inside surface said first and second O-Ring seals in sliding frictional and fluid sealing engagement with the outside face (100) of the closing sleeve; and, wherein said first and second O-Ring seals act cooperatively with third (98*a*) and fourth (98*b*) O-Ring seals located in each of the external grooves of the middle segment;

b. secondary seal means comprises a fifth O-Ring seal (91*a*) and a sixth O-Ring seal (91*b*) positioned in a fixed position within said inside circumferential recessed section of the top and bottom segments so that said fifth and sixth O-Ring seals are in sliding frictional and fluid sealing engagement with the outside face of the closing sleeve; and, c. tertiary seal means comprises a third (80*a*) and fourth (80*d*) Vee-stack seals mounted within the recessed sections of the top and bottom segments so that the Vee-stack seals abut the shoulders of the recessed sections (60*a*) and (60*b*).

7. The apparatus as claimed in claim 6 wherein a first pair of Vee stack seals comprising the third (80*a*) and first (80*b*) Vee-stack seals and a second pair of Vee stack seals comprising the second (80*c*) and fourth (80*d*) Vee-stack seals are enclosed within:

a. a top adapter ring (82) for enclosing the top of the third Vee-stack (80*a*) said ring having a flat outside surface and a concave inside surface (86);

b. a bottom adapter ring (84) for enclosing the bottom of first Vee-stack seal (80*b*) said bottom ring identical to said top ring; and wherein each Vee stack seal comprises at least three concavo-convex chevron-shaped seals in a stacked arrangement.

8. The apparatus as claimed in claim 7 wherein said first and second pairs of Vee-stack seals include an O-ring between them.

9. A sliding sleeve valve comprising a tubular body having coaxially joined top, middle and bottom segments, wherein:

a. said top segment comprises:
   i. an a internally threaded top end section for attachment to the adjacent section of a tube string;
   ii. an internally threaded bottom end section for attachment to said middle segment;
   iii. a circumferential recessed section having a top shoulder and adapted to receive seal means; and,
   iv. a circumferential bevel machined into the inside tip of the bottom of the top segment;

b. said middle segment having an external and internal surface and comprising:
   i. an externally threaded top end section for attachment to the threaded bottom end section of the top segment;
   ii. a radially apertured middle section for full fluid flow located below the top end section;
   iii. an externally threaded bottom end section located below the middle section;
   iv. a first groove machined circumferentially into the external surface of the middle segment immediately below said externally threaded top section and a second groove machined circumerferentially into the external surface of the middle segment immediately above said externally threaded bottom section said first and second grooves respectively spaced equidistantly above and below the apertured middle section;
   v. a third and fourth groove machined circumferentially into internal surface of the middle segment and positioned respectively above and below said first and second grooves and between the first and second grooves and the apertured middle section; wherein the bottom threaded section attaches to;

c. said bottom segment comprising;
   i. an internally threaded top end section for attachment to the externally threaded bottom end portion of the middle apertured segment;
   ii. an externally threaded bottom end section for attachment to the adjacent tube string;
   iii. a circumferential recessed section having a bottom shoulder and adapted to receive seal means, said recessed section located below said threaded portion; and,
   iv. a circumferential bevel machined into the inside tip of the bottom of the bottom segment;

d. a closing sleeve comprising a second non-segmented tubular body co-axially mounted within said first body in a sealed and sliding relationship with the first body said closing sleeve having a second set of wall apertures and a set of equalization ports equidistantly spaced above and below said second set of wall apertures for communication with said first set of apertures for desired full and equalization fluid flows respectively between the tube string and the annulus;

e. sealing means comprising a primary, secondary and tertiary seals acting in cooperative combinations for sealing undesired leakage flow pathways in a first and a second direction between the first body, the closing sleeve and the annulus; and, f. means for opening and closing the sliding sleeve valve from the surface.

10. The apparatus as claimed in claim 9 wherein the fluid contained within the tube string is at a higher pressure than the fluid contained in the annulus and wherein said first leakage flow direction is from the tube string to the annulus and wherein:

a. primary seal means comprises a first and second elastomeric O-Ring seal positioned in a fixed position within said inside circumferential recessed section of the top and bottom segments so that said O-Rings are in sliding frictional and fluid sealing engagement with the outside face of the closing sleeve;

b. secondary seal means comprises a first (80*b*) and second (80*c*) Vee-stack seals mounted within the recessed sections of the top and bottom segments so that the bottom of the first Vee-stack seals abuts the top tip of the middle segment and the top of the second Vee stack seal abuts the bottom tip of the middle segment;

c. tertiary seal means comprises a third and fourth O-Ring seals located within each of the internal grooves of the middle segment the inside surface said third and fourth O-Ring seals in sliding frictional and fluid sealing engagement with the outside face of the closing sleeve; and, wherein said third and fourth O-Ring seals act cooperatively with a fifth and sixth O-Ring seals located in each of the external grooves of the middle segment.

11. The apparatus as claimed in claim 10 wherein the fluid contained within the tube string is at a lower pressure than the fluid contained in the annulus and wherein said second leakage flow direction is from the annulus to the tube string and wherein:

a. primary seal means comprises said third and fourth O-Ring seals located within each of the internal grooves of the middle segment the inside surface said third and fourth O-Ring seals in sliding frictional and fluid sealing engagement with the outside face of the closing sleeve; and, wherein said third and fourth O-Ring seals act cooperatively with said fifth and sixth O-Ring seals located in each of the external grooves of the middle segment;

b. secondary seal means comprises said first and second elastomeric O-Ring seal positioned in a fixed position within said inside circumferential recessed section of the top and bottom segments so that said O-Rings are in sliding frictional and fluid sealing engagement with the outside face of the closing sleeve; and, c. tertiary seal means comprises a third (80*a*) and fourth (80*d*) Vee-stack seals mounted within the recessed sections of the top and bottom segments so that the top of the Vee-stack seals abuts the top and bottom shoulders of the recessed sections.

12. A method of assembling a sliding sleeve valve comprising the steps of:

a. taking top segment (20) of main body (12) and lubricating all internal surfaces including threaded portion (30) of the top segment with a suitable lubricant so that the closing sleeve (46) will slide easily within the main valve body;

b. taking the closing sleeve (46) and lubricating all external surfaces of the closing sleeve with a suitable lubricant in so that it slides easily within the main body;

c. inserting fully the closing sleeve (46) into the top segment (20) of the main valve body (12) in such a manner so as to avoid the formation of a pressure lock between the subsequently installed seals during thread make-up of the component and wherein once the closing sleeve is fully inserted, the end (51) of the closing sleeve will abut against shoulders (53) machined into the top segment of the valve body and wherein the bottom portion (57) of the sliding sleeve will extend outside of the top segment (20);

d. assembling third and first Vee-stack seals (80*a* and 80*b*) and first O-ring (91*a*) in combination comprising the following steps:

i. obtaining a top (82*a*) and bottom (84*a*) adapter ring and lubricating them on all sides;

ii. obtaining and lubricating third Vee-stack (80*a*) and placing it into the top adapter ring (82*a*);

iii. obtaining a first O-Ring (91*a*), lubricating it and placing it onto the third Vee-stack (80*a*);

iv. obtain and lubricating first Vee-stack (80*b*) placing it over the first O-ring (91*a*) so that the O-ring is sandwiched between the two adjacent Vee-stacks (80*a* and 80*b*); and, v. placing bottom adapter ring (84*a*) over the second Vee-stack (80*b*);

e. pushing assembled Vee stack/O-Ring combination seal onto the extending portion (57) of the closing sleeve and into the top segment (20) of the valve body so that the top of adapter ring (82*a*) abuts shoulder (60*a*) and the Vee-stack/O-ring combination sits in recess (59*a*);

f. measuring the dimension between the bottom of the installed seal pack and the bottom of the threaded portion (30) of the bottom segment and adjusting the distance so that the distance is not be less than the length of the threaded portion (34) of the middle segment (22);

g. obtaining third and fourth O-rings (92*a* and 92*b*) and lubricating them;

h. installing third and fourth O-rings into third (72*a*) and fourth (72*b*) grooves in the middle segment (22);

i. obtaining and lubricating fifth and sixth O-Ring seals (98*a*) and (98*b*);

j. installing fifth and sixth seals onto middle segment (22) so that the seals sit in first and second grooves (74*a*) and (74*b*);

k. lubricating top and bottom threads and internal sliding surfaces of the middle segment;

l. installing middle segment (22) onto the extending portion (57) of the closing sleeve and making-up threads (61*a*) and (63*a*) together so that they are hand tight;

m. obtaining bottom segment (24) of main body (12) and lubricating all internal surfaces;

n. repeating step d to assemble the second and fourth Vee-stack in combination with the second O-Ring (91*b*);

o. inserting the second and fourth Vee-seal stack/second O-Ring combination onto the remaining extended position of the closing sleeve;

p. measure the distance between second groove (74*b*) and the bottom of second adapter ring (84*b*) to ensure that it is not greater than the distance between second bevel (62*b*) and second shoulder (60*b*) and adjusting as necessary;

q. making-up threads (61*b*) and (63*b*) together so that they are hand tight; and, r. tightening threaded connections to a torque equal to the torque used to fasten the elements of the tubing sting together.

* * * * *